US010745989B2

(12) United States Patent
Xie et al.

(10) Patent No.: US 10,745,989 B2
(45) Date of Patent: Aug. 18, 2020

(54) DEEP ROCK IN-SITU ACTIVE THERMAL-INSULATION CORING DEVICE AND THERMAL-INSULATION CORING METHOD THEREOF

(71) Applicants: SHENZHEN UNIVERSITY, Shenzhen, Guangdong (CN); SICHUAN UNIVERSITY, Chengdu, Sichuan (CN)

(72) Inventors: Heping Xie, Guangdong (CN); Ling Chen, Guangdong (CN); Mingzhong Gao, Guangdong (CN); Cunbao Li, Guangdong (CN); Guangdi Deng, Guangdong (CN); Xia Hua, Guangdong (CN)

(73) Assignees: SHENZHEN UNIVERSITY, Shenzhen (CN); SICHUAN UNIVERSITY, Chengdu (CN)

( * ) Notice: Subject to any disclaimer, the term of this patent is extended or adjusted under 35 U.S.C. 154(b) by 0 days.

(21) Appl. No.: 16/708,412

(22) Filed: Dec. 9, 2019

(65) Prior Publication Data

US 2020/0181999 A1 Jun. 11, 2020

Related U.S. Application Data

(63) Continuation of application No. PCT/CN2018/119533, filed on Dec. 6, 2018.

(51) Int. Cl.

| | |
|---|---|
| ***E21B 25/08*** | (2006.01) |
| ***E21B 25/10*** | (2006.01) |
| ***E21B 44/00*** | (2006.01) |
| ***E21B 47/07*** | (2012.01) |
| ***E21B 25/00*** | (2006.01) |

(Continued)

(52) U.S. Cl.

CPC ..... *E21B 25/08* (2013.01); *E21B 25/00* (2013.01); *E21B 25/04* (2013.01); *E21B 25/06* (2013.01); *E21B 25/10* (2013.01); *E21B 44/00* (2013.01); *E21B 47/07* (2020.05)

(58) Field of Classification Search

CPC ..... E21B 25/00; E21B 25/04; E21B 25/06; E21B 25/08; E21B 25/10

See application file for complete search history.

(56) References Cited

U.S. PATENT DOCUMENTS

2009/0229382 A1* 9/2009 Sun ..... E21B 25/08 73/863.11

* cited by examiner

*Primary Examiner* — Tara Schimpf

(57) ABSTRACT

The present disclosure relates to the field of scientific drilling technologies, and provides a deep rock in-situ active thermal-insulation coring device and thermal-insulation coring method thereof. The coring device comprises an in-situ coring system and an in-situ truth-preserving moving system, the in-situ coring system comprises a driving module, a coring module and a thermal insulation module, and the in-situ truth-preserving moving system comprises a truth-preserving chamber storage module and a mechanical arm; the thermal insulation module comprises a coring truth-preserving chamber and a temperature regulation control system, the truth-preserving chamber storage module comprises a storage truth-preserving chamber and a temperature balance control system, the mechanical arm is mounted in the storage truth-preserving chamber, and the coring truth-preserving chamber and the storage truth-preserving chamber are mutually butted.

6 Claims, 2 Drawing Sheets

(51) Int. Cl.
*E21B 25/06* (2006.01)
*E21B 25/04* (2006.01)

DEEP ROCK IN-SITU ACTIVE THERMAL-INSULATION CORING DEVICE AND THERMAL-INSULATION CORING METHOD THEREOF

CROSS-REFERENCE TO RELATED APPLICATION

This application is a continuation of International Application No. PCT/CN2018/119533, filed on Dec. 6, 2018, the entire content of which is incorporated herein by reference.

TECHNICAL FIELD

The present disclosure belongs to the field of scientific drilling technologies, and in particular to a deep rock in-situ active thermal-insulation coring device and thermal-insulation coring method thereof.

BACKGROUND

With the rapid development of world economy, earth shallow resources are gradually exhausted, and earth deep resources are gradually developed. At present, the mining depth of coal is 1500 m, the mining depth of geothermal resources is over 3000 m, the mining depth of nonferrous metal mineral is over 4350 m, and the mining depth of oil and gas resources reaches 7500 m, so deep resource mining becomes the norm in the future. Exploration and development of the theory of deep in-situ rock mechanics and the testing technology are important foundation and key support for implementing the deep resource mining, and in-situ active thermal-insulation rock coring is a basic premise.

A large amount of scientific drilling researches are developed in China, but the in-situ active thermal-insulation coring technology is rarely involved and is only reported in the natural gas hydrate (soft rock) drilling field, and other truth-preserving coring devices are hard to actively insulate the heat. Compared with submarine sediment, a rock core often is at a high temperature, an objective of the thermal-insulation coring technology is to prevent the temperature of a rock core from reducing, but an objective of a submarine sediment truth-preserving coring technology is opposite, so the existing thermal insulation technology cannot be directly applied to the deep rock formation. Currently, the deep rock in-situ active thermal-insulation coring technology is still blank, so it urgently needs to develop an in-situ active thermal-insulation coring method applicable to the deep rock formation so as to provide a solid foundation to theorize the deep in-situ rock mechanics.

SUMMARY

A technical problem to be solved by embodiments of the present disclosure is to provide a deep rock in-situ active thermal-insulation coring device and thermal-insulation coring method thereof in order to solve a problem that in-situ active thermal-insulation coring of a deep earth rock cannot be achieved in the prior art so as to cause adverse effects to exploration of deep underground environment and research of deep rock mass mechanics behavior.

Embodiments of the present disclosure are achieved by providing a deep rock in-situ active thermal-insulation coring device, the device comprises an in-situ coring system and an in-situ truth-preserving moving system, the in-situ coring system comprises a driving module, a coring module and a thermal insulation module, and the in-situ truth-preserving moving system comprises a truth-preserving chamber storage module and a mechanical arm;

the thermal insulation module comprises a coring truth-preserving chamber and a temperature regulation control system, the temperature regulation control system is integrated in the coring truth-preserving chamber, the truth-preserving chamber storage module comprises a storage truth-preserving chamber and a temperature balance control system, the temperature balance control system is integrated in the storage truth-preserving chamber, the mechanical arm is mounted in the storage truth-preserving chamber, and the coring truth-preserving chamber and the storage truth-preserving chamber are mutually butted; and the driving module drives the coring module to extract a rock core having a formation in-situ temperature, the coring module conveys the extracted rock core to the coring truth-preserving chamber, the temperature regulation control system monitors the formation in-situ temperature and regulates the temperature of the rock core in the coring truth-preserving chamber to be consistent with the formation in-situ temperature in a coring procedure, the temperature balance control system regulates an internal temperature of the storage truth-preserving chamber to be consistent with an internal temperature of the coring truth-preserving chamber, and the mechanical arm moves the rock core to the storage truth-preserving chamber.

Furthermore, the driving module is a hydraulic motor.

Furthermore, the coring module comprises a drilling tool, a drilling bit, a claw and a central rod, the driving module drives the drilling tool to rotate, the drilling bit is mounted at the lower end of the drilling tool, the claw is mounted in the lower end of the drilling tool, and the central rod is connected with the coring truth-preserving chamber and drives the coring truth-preserving chamber to move in the drilling tool in a length direction of the drilling tool.

Furthermore, the coring truth-preserving chamber is a thermal-insulation cylinder capable of maintaining the formation in-situ temperature of the rock core.

Furthermore, the in-situ truth-preserving moving system further comprises a truth-preserving controller, and the coring truth-preserving chamber and the storage truth-preserving chamber are mutually butted through the truth-preserving controller.

Embodiments of the present disclosure further provide a thermal-insulation coring method of the above deep rock in-situ active thermal-insulation coring device. The thermal-insulation coring method of the deep rock in-situ active thermal-insulation coring device comprises the following steps:

firstly, the driving module drives the coring module to extract the rock core having the formation in-situ temperature; secondly, the coring module conveys the extracted rock core to the coring truth-preserving chamber, and the temperature regulation control system regulates the temperature of the rock core in the coring truth-preserving chamber to be consistent with the formation in-situ temperature of the rock core; thirdly, the mechanical arm moves the rock core in the coring truth-preserving chamber to the storage truth-preserving chamber to be stored; and meanwhile, the temperature balance control system regulates the internal temperature of the storage truth-preserving chamber to be the same as the internal temperature of the coring truth-preserving chamber so as to achieve that the temperature of the rock core to be consistent with the in-situ temperature in the whole procedure from rock core extraction to rock core storage.

In the present disclosure, the in-situ coring system can monitor the in-situ temperature of the rock core in real time and can also ensure that the temperature of the rock core in the coring truth-preserving chamber is consistent with the formation in-situ temperature in the coring procedure; and the in-situ truth-preserving moving system moves the rock core from the coring truth-preservation chamber to the storage truth-preservation chamber and can ensure that the temperature of the rock core is always consistent with the in-situ temperature in a rock core storage procedure and the rock core can be stored for a long time.

BRIEF DESCRIPTION OF THE DRAWINGS

In order to more clearly illustrate the technical solutions in the embodiments of the present disclosure, drawings used in the description of the embodiments will be briefly described below. Obviously, the drawings in the following description are some embodiments of the present disclosure. Those skilled in the art can also obtain other drawings based on these drawings without any creative efforts.

In the drawings, all reference signs are.

1—driving module, 2—truth-preserving controller, 3—mechanical arm, 4—coring truth-preserving chamber, 5—storage truth-preserving chamber, 6—drilling tool, 7—drilling bit, 8—claw and 9—central rod.

DESCRIPTION OF THE EMBODIMENTS

To make the objectives, technical solutions, and advantages of the present disclosure clearer, the following further describes the present disclosure in detail with reference to the accompanying drawings and embodiments. It should be understood that the described specific embodiments are merely used to explain the present disclosure rather than to limit the present disclosure.

Figure 1:
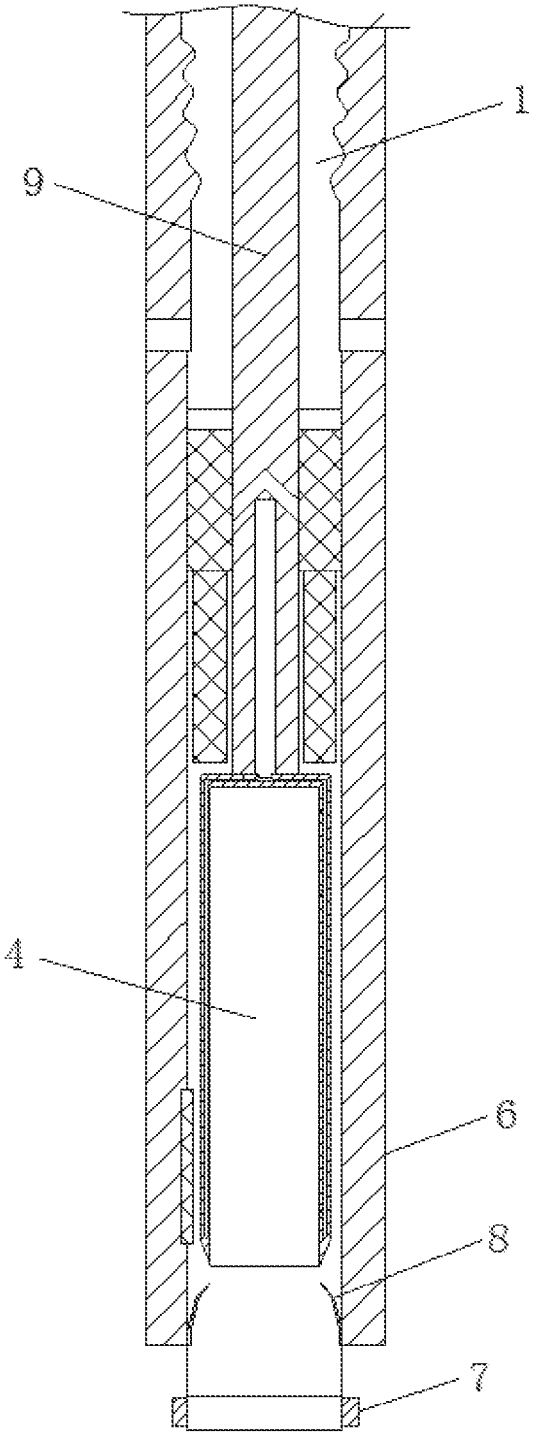
FIG. 1 is a schematic structural diagram of an in-situ coring system in a deep rock in-situ active thermal-insulation coring device provided in embodiments of the present disclosure.
Figure 2:
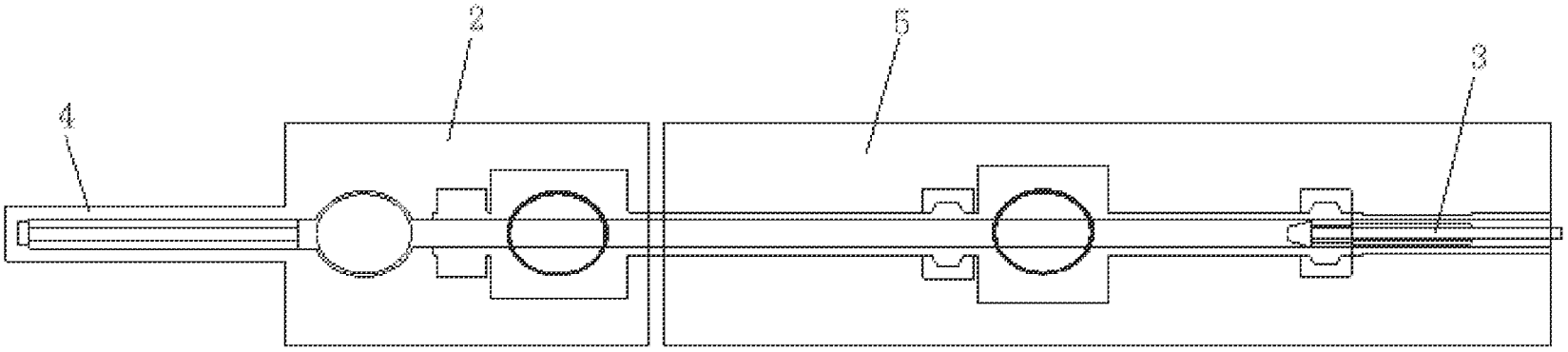
FIG. 2 is a schematic structural diagram showing a butting state of an in-situ truth-preserving moving system and a coring truth-preserving chamber in a deep rock in-situ active thermal-insulation coring device provided in embodiments of the present disclosure.

FIG. 1 and FIG. 2 show a deep rock in-situ active thermal-insulation coring device provided in embodiments of the present disclosure. The deep rock in-situ active thermal-insulation coring device comprises an in-situ coring system and an in-situ truth-preserving moving system, the in-situ coring system comprises a driving module 1, a coring module and a thermal insulation module, and the in-situ truth-preserving moving system comprises a truth-preserving controller 2, a truth-preserving chamber storage module and a mechanical arm 3. Wherein the thermal insulation module comprises a coring truth-preserving chamber 4 and a temperature regulation control system, the temperature regulation control system is integrated in the coring truth-preserving chamber, the truth-preserving chamber storage module comprises a storage truth-preserving chamber 5 and a temperature balance control system, the temperature balance control system is integrated in the storage truth-preserving chamber 5, the mechanical arm 3 is mounted in the storage truth-preserving chamber 5, and the coring truth-preserving chamber 4 and the storage truth-preserving chamber 5 are mutually butted through the truth-preserving controller 2.

In the embodiment, the driving module drives the coring module to extract a rock core having a formation in-situ temperature, the coring module conveys the extracted rock core to the coring truth-preserving chamber 4, the temperature regulation control system monitors the formation in-situ temperature and regulates the temperature of the rock core in the coring truth-preserving chamber 4 to be consistent with the formation in-situ temperature in a coring procedure, the temperature balance control system regulates an internal temperature of the storage truth-preserving chamber 5 to be consistent with an internal temperature of the coring truth-preserving chamber 4, and the mechanical arm 3 moves the rock core in the coring truth-preserving chamber 4 to the storage truth-preserving chamber 5 through the truth-preserving controller 2.

In the embodiment, the coring truth-preserving chamber 4 is a thermal-insulation cylinder capable of maintaining the formation in-situ temperature of the rock core. The driving module 1 is a hydraulic motor. The coring module comprises a drilling tool 6, a drilling bit 7, a claw 8 and a central rod 9, the hydraulic motor in the driving module 1 drives the drilling tool 6 to rotate, and the drilling bit 7 is mounted at the lower end of the drilling tool 6 to drive the drilling bit 7 to extract the rock core. The claw 8 is mounted in the lower end of the drilling tool 6, and the rock core is tightly gripped through the claw 8. The central rod 9 is connected with the coring truth-preserving chamber 4 and drives the coring truth-preserving chamber 4 to move in the drilling tool 6 in a length direction of the drilling tool 6.

Embodiments of the present disclosure further provide a thermal-insulation coring method of the above deep rock in-situ active thermal-insulation coring device. The thermal-insulation coring method of the deep rock in-situ active thermal-insulation coring device comprises the following steps:

Before coring, preparations of a coring drilling rig need to be performed on the ground, shear pins are mounted, a mounting operation of the drilling rig is completed, a pressure drilling fluid is fed into the drilling rig through the rope pipeline such that the drilling fluid enters the driving module, and the driving module 1 drives the drilling bit 7 at the coring module to start cutting a rock so as to extracting a rock core having the formation in-situ temperature; when the length of the extracted rock core reaches a preset length, the claw 8 in the drilling tool 6 grips the rock core; and then the central rod 9 on the coring module lifts up, and because the rock core cannot resist a great tension, the rock core is broken by the claw 8, the broken rock core continues to move upwards and to be conveyed into the coring truth-preserving chamber 4, and the temperature regulation control system regulates the temperature of the rock core in the coring truth-preserving chamber 4 to be consistent with the formation in-situ temperature of the rock core; and After the rock core enters the coring truth-preserving chamber 4, the coring truth-preserving chamber 4 is detached, and intelligent butting of the coring truth-preserving chamber 4 and the storage truth-preserving chamber 5 is achieved through the truth-preserving controller 2 in the in-situ truth-preserving moving system; after the butting is completed, the mechanical arm 3 moves the rock core in the coring truth-preserving chamber 4 to the storage truth-preserving chamber 5 through the truth-preserving controller 2 to be stored, and meanwhile, the temperature balance control system regulates the internal temperature of the storage truth-preserving chamber 5 to be the same as the internal temperature of the coring truth-preserving chamber 4 in order to achieve that the temperature of the rock core is consistent with the in-situ temperature when the rock core moves to the storage truth-preserving chamber 5.

In conclusion, according to the present disclosure, the in-situ coring system monitors the in-situ temperature of the rock core in real time and can ensure that the temperature of the rock core in the coring truth-preserving chamber 4 is consistent with the formation in-situ temperature in the coring procedure; and the in-situ truth-preserving moving system moves the rock core from the coring truth-preservation chamber 4 to the storage truth-preservation chamber 5 and can ensure that the temperature of the rock core is consistent with the in-situ temperature in a rock core storage procedure, so that the temperature of the rock core is consistent with in-situ temperature from the coring procedure to the rock core storage procedure, and the rock core can be stored for a long time.

The above merely describes preferred embodiments of the present disclosure, but is not used to limit the present disclosure. Any modifications, equivalent replacements, improvements and the like within the spirit and principle of the present disclosure shall be all contained in the protection scope of the present disclosure.

What is claimed is:

1. A deep rock in-situ active thermal-insulation coring device comprising an in-situ coring system and an in-situ truth-preserving moving system, wherein the in-situ coring system comprises a driving module, a coring module and a thermal insulation module, and the in-situ truth-preserving moving system comprises a truth-preserving chamber storage module and a mechanical arm;

the thermal insulation module comprises a coring truth-preserving chamber and a temperature regulation control system, the temperature regulation control system is integrated in the coring truth-preserving chamber, the truth-preserving chamber storage module comprises a storage truth-preserving chamber and a temperature balance control system, the temperature balance control system is integrated in the storage truth-preserving chamber, the mechanical arm is mounted in the storage truth-preserving chamber, and the coring truth-preserving chamber and the storage truth-preserving chamber are mutually butted; and the driving module drives the coring module to extract a rock core having a formation in-situ temperature, the coring module conveys the extracted rock core to the coring truth-preserving chamber, the temperature regulation control system monitors the formation in-situ temperature and regulates the temperature of the rock core in the coring truth-preserving chamber to be consistent with the formation in-situ temperature in a coring procedure, the temperature balance control system regulates an internal temperature of the storage truth-preserving chamber to be consistent with an internal temperature of the coring truth-preserving chamber, and the mechanical arm moves the rock core to the storage truth-preserving chamber.

2. The deep rock in-situ active thermal-insulation coring device of claim 1, wherein the driving module is a hydraulic motor.

3. The deep rock in-situ active thermal-insulation coring device of claim 1, wherein the coring module comprises a drilling tool, a drilling bit, a claw and a central rod, the driving module drives the drilling tool to rotate, the drilling bit is mounted at the lower end of the drilling tool, the claw is mounted in the lower end of the drilling tool, and the central rod is connected with the coring truth-preserving chamber and drives the coring truth-preserving chamber to move in the drilling tool in a length direction of the drilling tool.

4. The deep rock in-situ active thermal-insulation coring device of claim 3, wherein the coring truth-preserving chamber is a thermal-insulation cylinder capable of maintaining the formation in-situ temperature of the rock core.

5. The deep rock in-situ active thermal-insulation coring device of claim 1, wherein the in-situ truth-preserving moving system further comprises a truth-preserving controller, and the coring truth-preserving chamber and the storage truth-preserving chamber are mutually butted through the truth-preserving controller.

6. A thermal-insulation coring method of the deep rock in-situ active thermal-insulation coring device of claim 1, wherein the thermal-insulation coring method comprises the following steps:

firstly, the driving module drives the coring module to extract the rock core having the formation in-situ temperature; secondly, the coring module conveys the extracted rock core to the coring truth-preserving chamber, and the temperature regulation control system regulates the temperature of the rock core in the coring truth-preserving chamber to be consistent with the formation in-situ temperature of the rock core; thirdly, the mechanical arm moves the rock core in the coring truth-preserving chamber to the storage truth-preserving chamber to be stored; and meanwhile, the temperature balance control system regulates the internal temperature of the storage truth-preserving chamber to be the same as the internal temperature of the coring truth-preserving chamber so as to achieve that the temperature of the rock core to be consistent with the in-situ temperature in the whole procedure from rock core extraction to rock core storage.

* * * * *